US005867825A

United States Patent [19]

Scheerer

[11] Patent Number: 5,867,825

[45] Date of Patent: Feb. 9, 1999

[54] CUFFED AND FOLDED GARMENT PACKAGE AND METHOD OF FORMING SAME TO PREVENT CONTAMINATION

[76] Inventor: Michael Robert Scheerer, 414 E. Turnberry Ct., Weschester, Pa. 19382

[21] Appl. No.: 914,491

[22] Filed: Aug. 19, 1997

Related U.S. Application Data

[60] Provisional application No. 60/054,274 Jul. 30, 1997.

[51] Int. Cl. [6] ..... A41D 13/12; B65D 85/18; A61B 19/00; A47G 25/90

[52] U.S. Cl. ..... 2/69; 2/114; 206/278; 53/429; 53/117; 128/855

[58] Field of Search ..... 2/69, 114, 901, 2/269, 79; 206/278, 278.1, 8, 11, 279, 280–287, 287.1, 288–299, 400; 53/429, 117; 223/37, 111; 128/849–857

[56] References Cited

U.S. PATENT DOCUMENTS

| | | |
|---|---|---|
| 2,187,447 | 1/1940 | Chait et al. . |
| 2,524,448 | 10/1950 | Kaplan . |
| 2,573,414 | 10/1951 | Dunn . |
| 2,849,167 | 8/1958 | Walser, Jr. . |
| 3,107,786 | 10/1963 | Adelman . |
| 3,359,569 | 12/1967 | Rotanz et al. . |
| 3,372,799 | 3/1968 | Abildgaard . |
| 3,384,225 | 5/1968 | Nye . |
| 3,391,855 | 7/1968 | Ansell . |
| 3,419,908 | 1/1969 | Germani . |
| 3,496,572 | 2/1970 | Herzig . |
| 4,214,320 | 7/1980 | Belkin . |
| 4,475,253 | 10/1984 | Laveckis . |
| 4,523,335 | 6/1985 | Scrivens . |
| 4,677,696 | 7/1987 | Tanaka . |
| 4,705,171 | 11/1987 | Eldridge . |
| 4,752,972 | 6/1988 | Neckerman et al. . |
| 4,773,100 | 9/1988 | Kuo . |
| 4,845,779 | 7/1989 | Wheeler et al. . |
| 4,860,382 | 8/1989 | Markwell . |
| 4,942,987 | 7/1990 | Stackhouse . |
| 4,971,233 | 11/1990 | Keenan . |
| 5,065,863 | 11/1991 | Moyet-Ortiz . |
| 5,067,179 | 11/1991 | Wormser . |
| 5,073,988 | 12/1991 | Lewis, Jr. et al. . |
| 5,097,534 | 3/1992 | Viemeister et al. . |
| 5,511,246 | 4/1996 | Farkas et al. . |
| 5,533,209 | 7/1996 | Davis . |

*Primary Examiner*—Michael A. Neas
*Assistant Examiner*—Shirra L. Jenkins
*Attorney, Agent, or Firm*—Trexler, Bushnell, Giangiorgi & Blackstone, Ltd.

[57] ABSTRACT

A novel garment package and a novel method of forming a sterile garment package to facilitate donning of a garment by a wearer is disclosed in the present invention. The method of forming the garment package may be used to fold a sleeve, a shoe cover, a hood, a coverall or other like garments. The method is performed by laying the garment on a surface in a flattened condition with the exterior surface of the garment exposed; cuffing a portion of the garment around the opening to expose a portion of the interior surface of the garment while leaving a portion of the exterior surface of said garment exposed; and, at least one time, folding the cuffed portion of the garment over onto the exposed portion of the exterior surface. Thereafter, the cuffed and folded may be placed in a bag and the bag is sealed. To don the garment, the wearer solely grasps and handles the garment by the exposed interior surface and prevents the garment from contacting the floor. This deters contact of the garment with contaminants which may be on the wearer's skin, clothes or on the floor.

31 Claims, 11 Drawing Sheets

FIG. 2
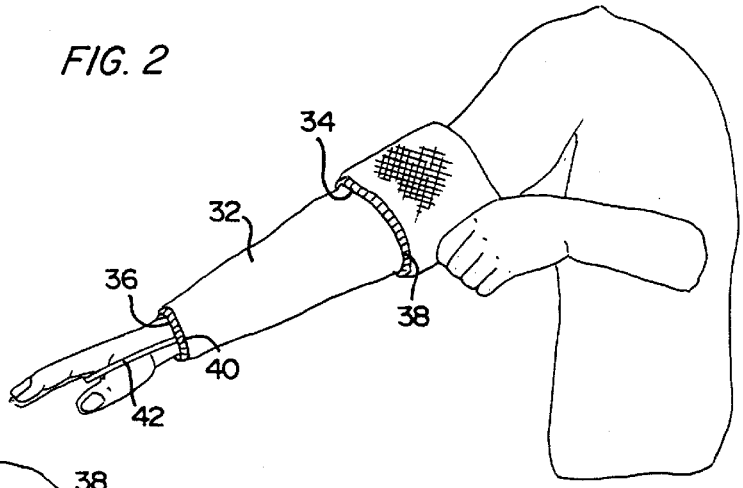
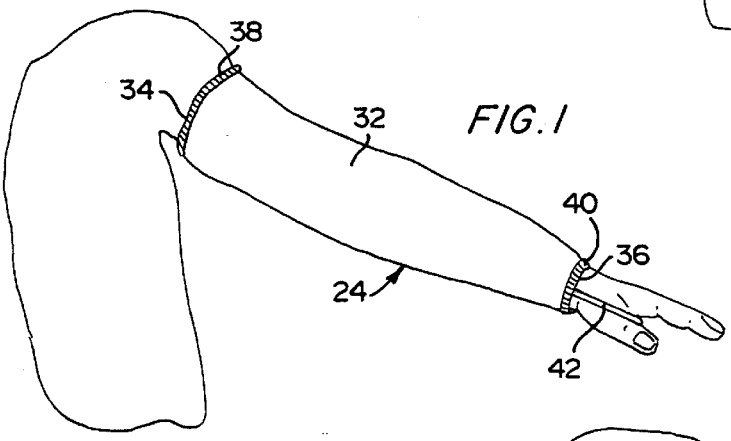
FIG. 1
FIG. 11
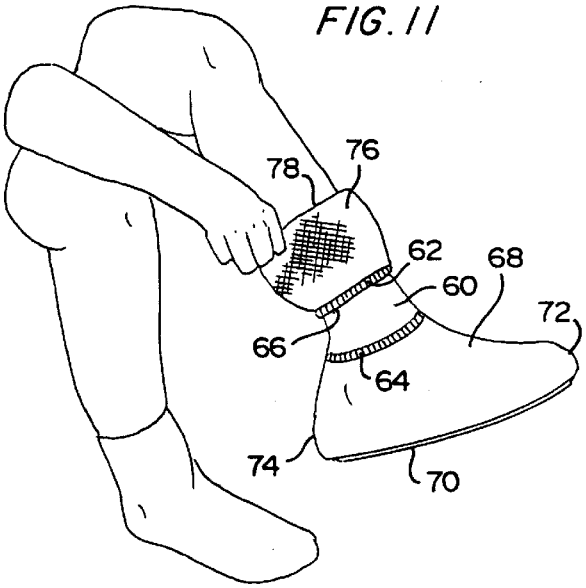
FIG. 10
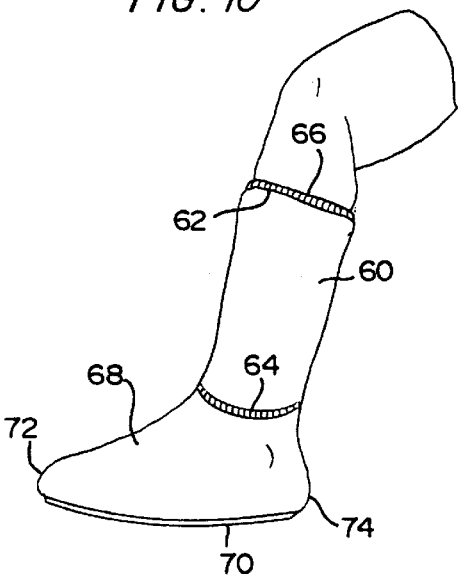

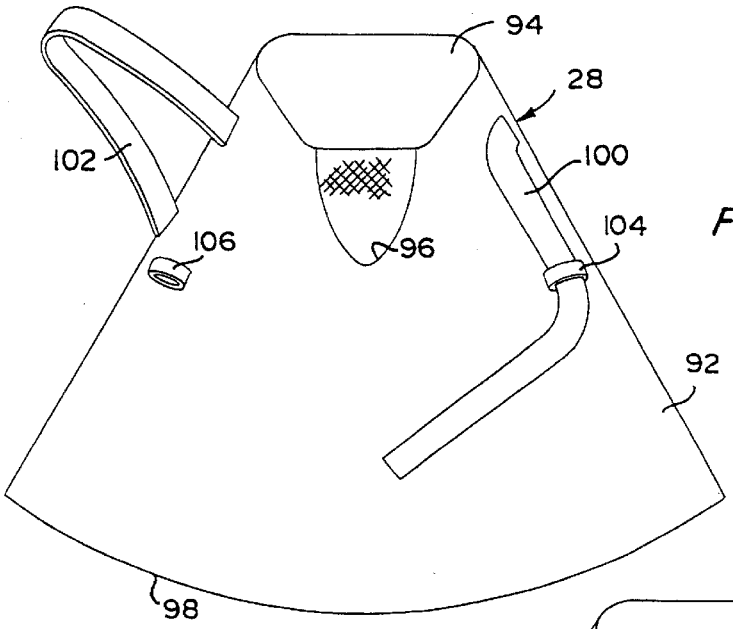
FIG. 23
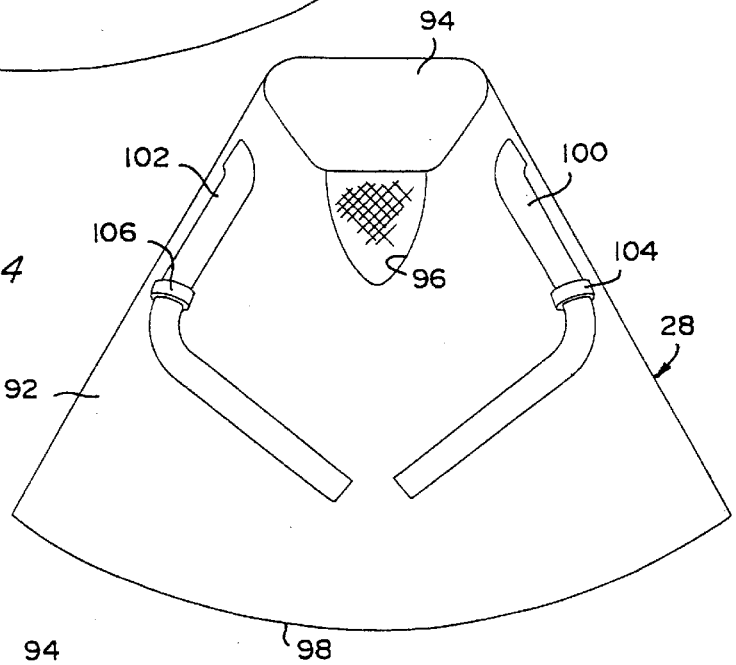
FIG. 24
FIG. 25
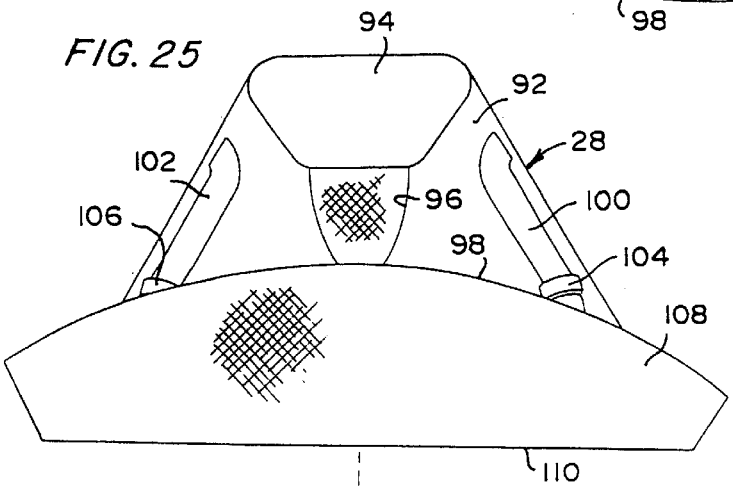
FIG. 26
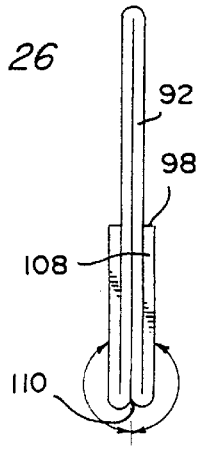

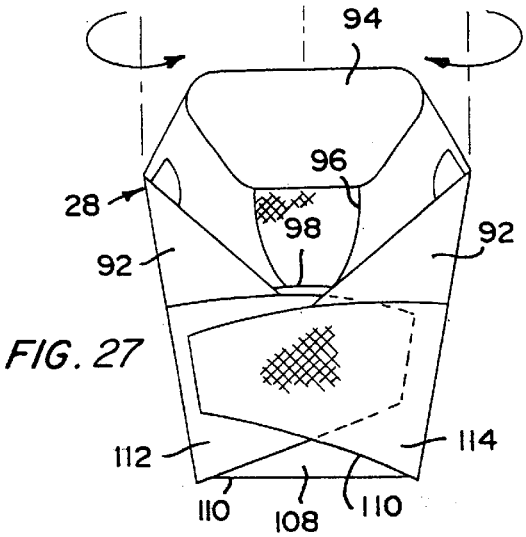
FIG. 27
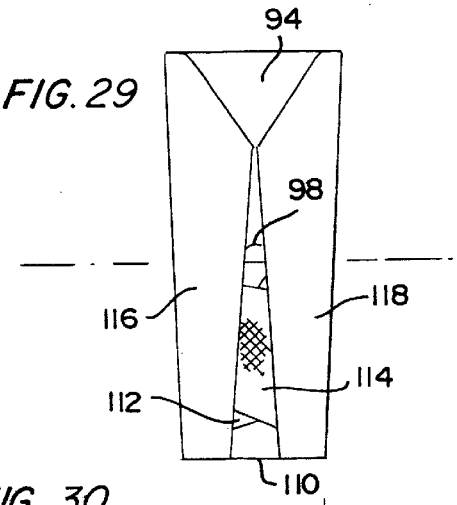
FIG. 29
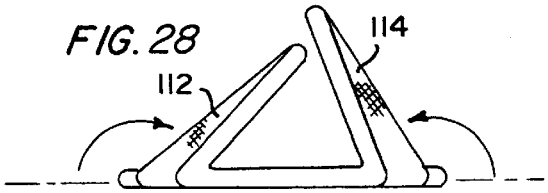
FIG. 28
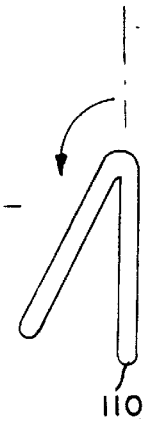
FIG. 30
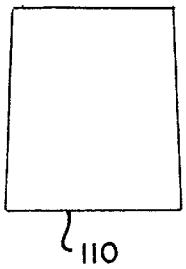
FIG. 31
FIG. 32
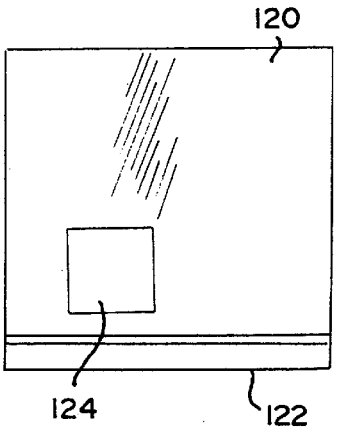
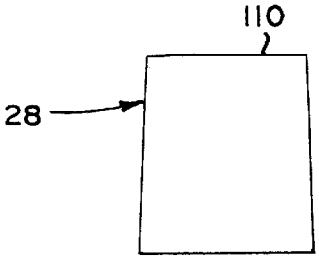
128
FIG. 33
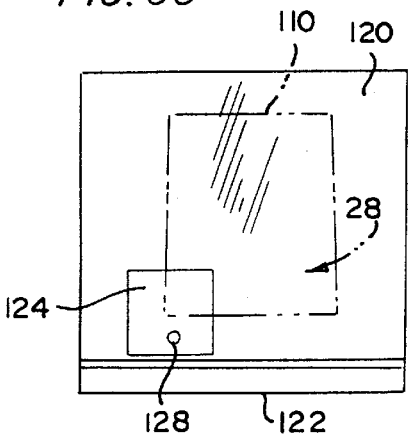

CUFFED AND FOLDED GARMENT PACKAGE AND METHOD OF FORMING SAME TO PREVENT CONTAMINATION

This application claims the priority of Provisional application Ser. No. 60/054,274 filed on Jul. 30, 1997 entitled "Cuffed and Folded Garment Package and Method of Forming Same To Prevent Contamination".

BACKGROUND OF THE INVENTION

This invention is generally directed to a novel packaged cuffed and folded garment and a novel method of forming same which prevents contamination of the garment when it is being donned by a wearer. More particularly, the invention contemplates a novel method of folding and packaging a garment which allows a wearer to remove the garment from the packaging and don the garment while only touching the interior surfaces of the garment during removal and donning.

It is desired to prevent contamination of a garment during donning by wearer when such a garment is for use in cleanroom and during surgical procedures. Often, with prior art garments, exterior surfaces of the garments are exposed to contamination from the wearer's hands and body during donning and from the garment contacting the floor during donning by the wearer.

The present invention provides a novel packaged cuffed and folded garment and a novel method of forming same which prevents contamination of the garment when it is being donned by a wearer which substantially prevents contamination of the garment by the wearer or by the garment contacting the floor. Other features and advantages will become apparent upon a reading of the attached specification in combination with an examination of the drawings.

OBJECTS AND SUMMARY OF THE INVENTION

A general object of the present invention is to provide a novel packaged folded garment and a novel method of folding same which prevents contamination of the garment when it is being donned by a wearer.

An object of the present invention is to provide a novel method of folding and packaging a garment which allows a wearer to remove the garment from the packaging and don the garment while only touching the interior surfaces of the garment during removal and donning thereby not allowing the wearer from touching the exterior of the garment during donning to prevent particle, extractable and bio-contamination from the hands of a wearer.

Another object of the present invention is to provide a novel method of folding and packaging a garment which allows a wearer to don the garment such that the garment does not touch the floor, thereby preventing contamination of the garment.

Yet a further object of the present invention to provide a novel package and method of packaging the garment so that the garment can be put on by the wearer with out positioning the garment before donning, thereby preventing contamination of the garment and saving time during donning.

Briefly, and in accordance with the foregoing, the present invention discloses a novel garment package and a novel method of forming a garment package. The manner in which the garment is packaged facilitates donning of the garment by a wearer.

The method of forming the garment package may be used to fold a sleeve, a shoe cover, a hood, a coverall or other like garments. The method is performed by laying the garment on a surface in a flattened condition with the exterior surface of the garment exposed; cuffing a portion of the garment around the opening to expose a portion of the interior surface of the garment while leaving a portion of the exterior surface of said garment exposed; and, at least one time, folding the cuffed portion of the garment over onto the exposed portion of the exterior surface. Thereafter, the cuffed and folded may be placed in a bag and the bag is sealed.

To don the garment, the wearer solely grasps and handles the garment by the exposed interior surface and prevents the garment from contacting the floor. This deters contact of the garment with contaminants which may be on the wearer's skin, clothes or on the floor.

BRIEF DESCRIPTION OF THE DRAWINGS

The organization and manner of the structure and operation of the invention, together with further objects and advantages thereof, may best be understood by reference to the following description, taken in connection with the accompanying drawings. In the drawings, the thicknesses of the garments, such as the sleeves, the shoe covers, the hoods and the coveralls, in the side elevational views are exaggerated for understanding the invention. In the drawings, like reference numerals identify like elements in which:

FIG. 1 is a perspective view of a sleeve which has been donned by a wearer;

FIG. 2 is a perspective view of the sleeve shown in FIG. 1 being donned by the wearer;

Specifically, FIG. 4 is a top plan view of the sleeve after being cuffed and FIG. 5 is a side elevational view showing same;

FIG. 6 is a side elevational view showing the sleeve being folded half;

FIG. 7 is a top plan view showing the sleeve after it has been folded in half;

FIG. 8 is a top plan view showing a bag and a pair of sleeves, each of which have been folded in accordance with the steps shown in FIGS. 3–7; and FIG. 9 is a top plan view showing the completed sleeve package.

FIG. 10 is a perspective view of a shoe cover which has been donned by a wearer;

FIG. 11 is a perspective view of the shoe cover shown in FIG. 10 being donned by the wearer;

Specifically, FIG. 13 is a top plan view of the shoe cover after being cuffed and FIG. 14 is a side elevational view showing same;

FIG. 15 is a top plan view of the shoe cover after it has been folded and FIG. 16 is a side elevational view showing the shoe cover being folded;

FIG. 17 is a side elevational view of the shoe cover again being folded;

FIG. 18 is a top plan view of the shoe cover after it has been folded as shown in FIG. 17;

FIG. 19 is a top plan view showing a bag and a pair of shoe covers, each of which have been folded in accordance with the steps shown in FIGS. 13–18; and FIG. 20 is a top plan view showing the completed shoe cover package.

FIGS. 23–33 show the steps in cuffing, folding and packaging the hood in accordance with the features of the invention.

Specifically, FIG. 23 is a top plan view of the hood in a flattened condition with one tie drawn through a loop;

FIG. 24 is a top plan view of the hood in a flattened condition with both ties drawn through respective loops;

FIG. 25 is a top plan view of the hood after being cuffed and FIG. 26 is a side elevational view showing same;

FIG. 27 is a top plan view of the hood after it has been folded and FIG. 28 is a side elevational view showing the hood being folded;

FIG. 29 is a top plan view of the hood again being folded;

FIG. 30 is a side elevational view of the hood again being folded and FIG. 31 is a top plan view of the hood after it has been folded as shown in FIG. 30;

FIG. 32 is a top plan view showing a bag and a hood; and

FIG. 33 is a top plan view showing the completed hood package.

Specifically, FIG. 37 is a top plan view of the coverall having one arm portion and one leg portion being cuffed;

FIG. 38 is a top plan view of the coverall after a left side portion of the coverall has been folded;

FIG. 39 is a top plan view of the coverall after a right side portion of the coverall has been folded;

FIG. 40 is a top plan view of the coverall after the leg portions have been partially folded;

FIG. 41 is a top plan view of the coverall after the leg portions have been completely folded;

FIG. 42 is a top plan view showing the coverall after being turned over in its folded condition;

FIGS. 43 and 44 are top plan views showing the chest portion of the coverall being rolled open;

FIG. 45 is a top plan view showing a bag and the coverall; and

FIG. 46 is a top plan view showing the completed coverall package.

DETAILED DESCRIPTION OF THE PREFERRED EMBODIMENT

Figure 3:
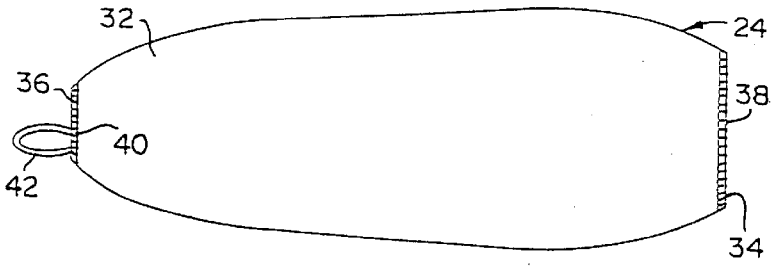
FIG. 3 is a top plan view of the sleeve in a flattened condition.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The present invention presents a novel cuffed and folded garment package and a novel method of cuffing and folding same which prevents contamination of the garment when the garment is being donned by a wearer. The novel method of the present invention allows a wearer to remove the garment from the packaging and don the garment while only touching interior surfaces of the garment during removal and donning. As shown in the drawings, for convenience in understanding the drawings, the interior surface of the garment is shown with crossed shading. Also, in the drawings showing side elevational views, the thicknesses of the garments are exaggerated for understanding the invention.

The present invention relates to garments, such as sleeves 24, shown in FIGS. 1–9; shoe covers 26, shown in FIGS. 10–20; hoods 28, shown in FIGS. 21–33; and coveralls 30, shown in FIGS. 34–46. The garments may be disposable, that is, the garment is used once and thrown away, or reusable, that is, the garment is laundered and repackaged for use more than once. The disposable garments may be made of TYVEX®, which is a registered trademark of the DuPont Corporation, laminated, spunbond laminates, film, or the like. The reusable garments may be made of polyester or various laminated materials. The garments are cuffed and folded in accordance with the novel method described herein and before sale are using, for example, steam or ethylene oxide sterilization techniques.

Attention is now directed to the specifics of packaging and donning the sleeve 24. The sleeve 24 is shown in its donned position in FIG. 1 and its method of donning by a wearer is partially shown in FIG. 2. As shown, the sleeve 24 is formed from a generally tubular body portion 32 having a first larger end defining a first larger opening 34 and an opposite, second smaller end defining a second smaller opening 36. A seam is provided along the length of the sleeve 24 to form the tubular configuration by securing the edges of the sleeve material along the length thereof by suitable means, such as by sewing. Elastic bands 38, 40 are secured at the opposite ends of the sleeve 24 and form the smaller and larger openings 34, 36 by placing the elastic bands 38, 40 at the ends of the tubular body portion 32 and folding the ends of the body portion 32 over the respective elastic bands 38, 40 and securing this folded over configuration by suitable means, such as by sewing. A thumb loop 42 is provided at the smaller opening 36 of the sleeve 24 for reasons described herein.

The novel method of cuffing, folding and packaging the sleeve 24 is shown in FIGS. 3–20.

First, as generally shown in FIG. 3, a folder (not shown) places the sleeve 24 on a folding table (not shown) with the larger opening 34 of the sleeve 24 facing the right-hand-side as shown in the drawings. All of the wrinkles in the sleeve 24 are smoothed out, so that the sleeve 24 is completely flat.

Figure 4:
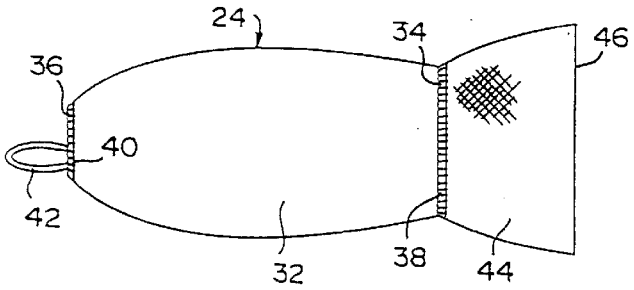
FIGS. 4–9 show the steps in cuffing, folding and packaging a pair of the sleeves in accordance with the features of the invention.
Figure 6:
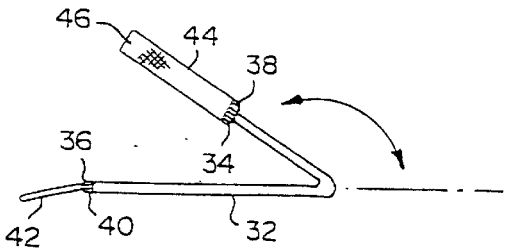
Figure 5:
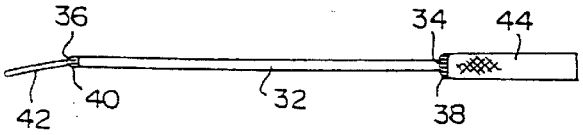
Figure 7:
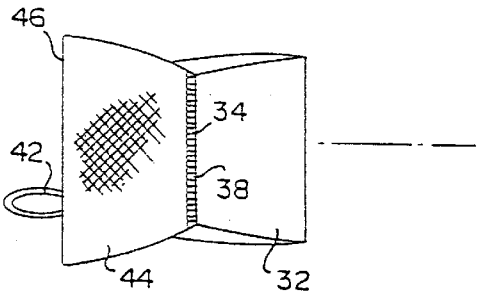

Next, as shown in FIG. 4, the first end of the sleeve 24 proximate to the larger opening 34 is grasped and the end of the sleeve 24 is cuffed or turned inside-out around the entire circumference of the sleeve 24 to form a cuffed portion 44 as shown in FIGS. 4 and 5. That is, the elastic band 38 is moved from the end as shown in FIG. 3, to a position which is intermediate of the body portion 32 as shown in FIGS. 4 and 5, thereby exposing a portion of the interior surface of the sleeve 24 while leaving a portion of the exterior of the sleeve 24 exposed. The sleeve 24 is cuffed to expose approximately four inches of the interior of the sleeve 24. The cuffed portion 44 defines a cuffed opening 46. Next, as shown in FIG. 6, the sleeve 24 is grasped at the cuffed opening 46 defined by the cuffed portion 44 and is folded generally in half, so that the openings 36, 46 are even and aligned with each other, see FIG. 7.

Figure 8:
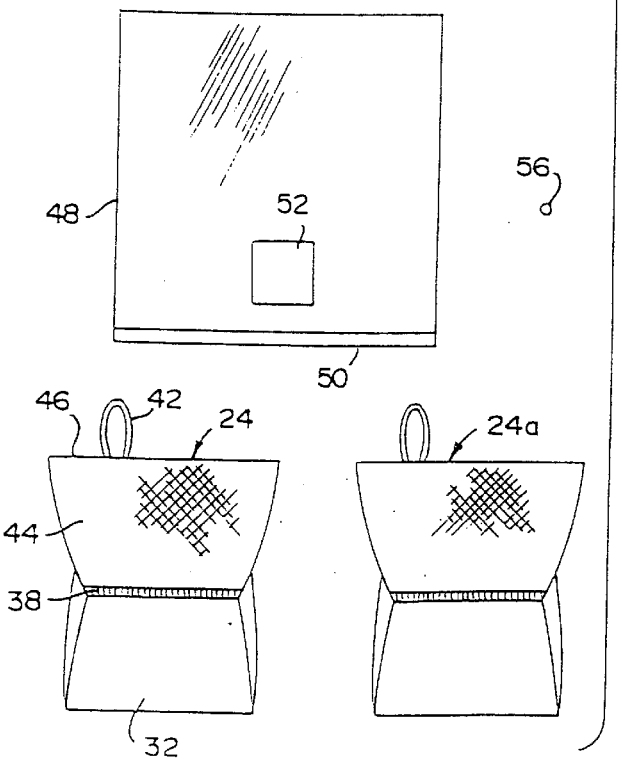

Thereafter, the steps discussed above and shown in FIGS. 3–6 are repeated with another sleeve to form a like folded sleeve 24*a* as shown in FIG. 8.

Next, as shown in FIG. 8, each of the sleeves 24, 24*a* are rotated so that the cuffed opening 46 of each sleeve 24, 24*a* is away from the folder. The sleeves 24, 24*a* then are stacked on top of each other.

As shown in FIG. 8, a bag 48 is placed on the folding table with the opening 50 of the bag 48 facing the folder and a label 52 which has been pre-supplied on the bag 48 facing upwardly to the folder. The stacked pair of sleeves 24, 24*a* are placed in the bag 48 with the cuffed opening 46 first entering the bag 48.

Figure 9:
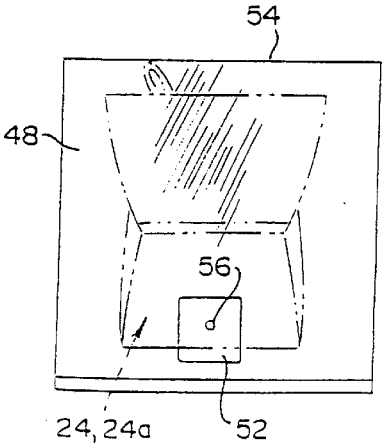

If the folder is packaging disposable, sterile nonlaundered sleeves, the bag 48 is vacuum sealed to form a pair package 54 of sleeves 24, 24*a* as shown in FIG. 9. If the folder is reusable, packaging laundered cleanroom sleeves 24, 24*a*, the air is pushed out of the bag 48 and the bag 48 is heat sealed to form a pair package 54 of sleeves 24, 24*a* as shown in FIG. 9. A pressure sensitive label 56 is placed on the label 52 on the bag 48 to denote what type of sleeves 24, 24*a* the bag 48 contains, see FIG. 9.

To don one of the sleeves 24, the wearer opens the non-sealed end of the bag 48 which has the cuffed portion 44 proximate thereto. The cuffed portion 44 of the sleeve 24 is grasped by the wearer, such that only the interior surface of the sleeve 24 is grasped during removal from the bag 48 and during subsequent handling by the wearer during donning. As shown in FIG. 2, the wearer inserts his or her arm through the cuffed opening 46 and only by touching the cuffed portion 44 of the sleeve 24, the wearer extends his or her hand and arm through the sleeve 24 until the wearer's hand emerges from the smaller opening 36. As the wearer's arm is inserted therein, the sleeve 24 unfolds without the wearer touching the exterior surface of the sleeve 24. The elastic band 40 causes the second end of the sleeve 24 to securely grip the wearer's wrist. As the wearer's hand exits the smaller opening 36, the wearer places his or her thumb through the thumb loop 42. Thereafter, the cuffed portion 44 of the sleeve 24 is uncuffed, with the wearer only grasping the interior surface of the sleeve 24 until the cuffed portion 44 is completely uncuffed. The elastic band 38 securely grasps the wearer's upper arm as shown in FIG. 1 and the sleeve 24 is completely donned. Thus, the sleeve 24 is easily donned without the wearer touching the exterior surface of the sleeve 24. Thereafter, the same procedure is used to don the other sleeve 24*a*.

Attention is now directed to the specifics of packaging and donning the shoe cover 26. The shoe cover 26 is shown in its donned position in FIG. 10 and its method of donning by a wearer is partially shown in FIG. 11. As shown, an upper leg portion of the shoe cover 26 is formed from a generally tubular leg portion 60 having opposite ends in which elastic bands 62, 64 are secured in a like manner to that of the sleeve 24 described hereinabove. A seam is provided along the length of the tubular portion 60 by securing the edges of the upper portion material along the length thereof by suitable means, such as by sewing. The upper elastic band 62 around the upper end of the tubular portion 60 defines an opening 66. A lower foot portion of the shoe cover 26 is formed from a piece of material that has its edges secured together by suitable means, such as by sewing, to form a seam. The lower foot portion of the shoe cover 26 includes a top portion 68 and a sole 70. A toe and a heel are defined by the lower foot portion. An opening in the top portion 68 of the shoe cover 26 is suitably secured to the lower end of the tubular leg portion 60 and an opening in the top portion 68 of the shoe cover 26 is secured to a sole 70, by suitable means, such as by sewing. The sole 70 of the shoe cover 26 can have a non-slip material provided thereon.

The novel method of cuffing, folding and packaging the shoe cover 26 is shown in FIGS. 12–19.

Figure 12:
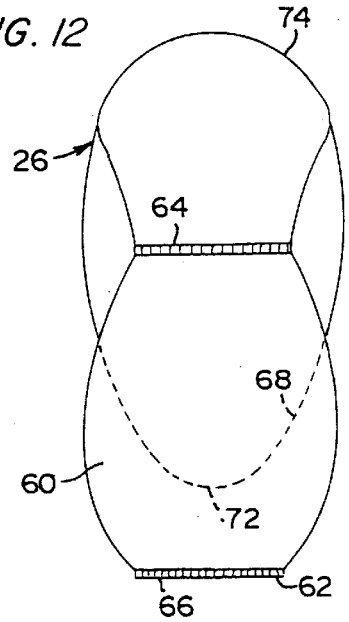
FIG. 12 is a top plan view of the shoe cover in a flattened condition.
Figure 13:
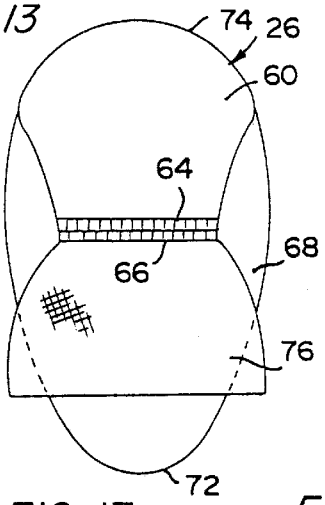
FIGS. 13–20 show the steps in cuffing, folding and packaging a pair of the shoe covers in accordance with the features of the invention.
Figure 14:
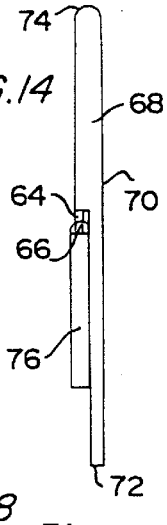
Figure 15:
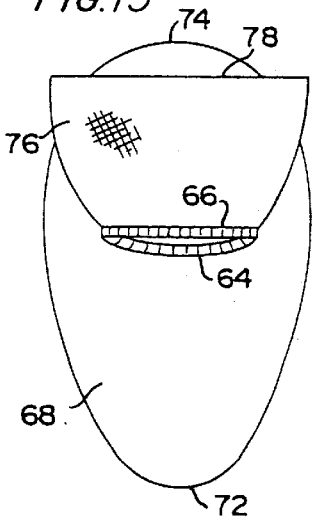
Figure 16:
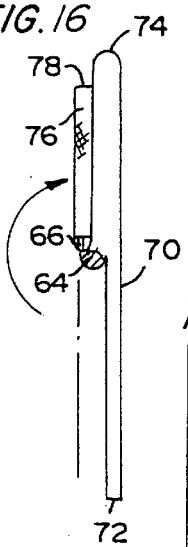
Figure 17:
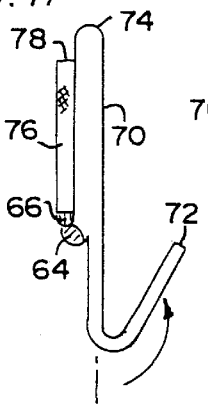
Figure 18:
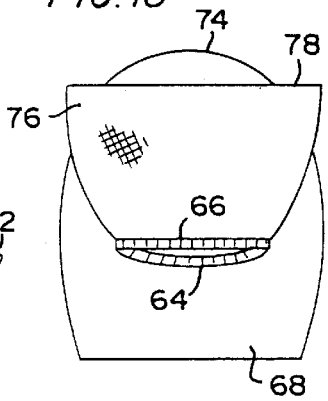

First, as generally shown in FIG. 12, a folder (not shown) places the shoe cover 26 on a folding table (not shown) with the toe 72 of the shoe cover 26 facing the folder. The tubular leg portion 60 collapses downwardly on top of the top portion 68 of the foot portion. The end of the shoe cover 26 proximate to the opening 66 is grasped and the end portion of the shoe cover 26 is cuffed or turned inside-out around the entire circumference of the tubular leg portion 60 of the shoe cover 26 to form a cuffed portion 76 as shown in FIGS. 13 and 14. That is, the elastic band 62 is moved from the end as shown in FIG. 12, to a position which is intermediate of the leg portion 60 as shown in FIGS. 13 and 14, thereby exposing a portion of the interior surface of the leg portion 60 while leaving the remainder of the exterior of the shoe cover 26 exposed. Preferably, the leg portion 60 of the shoe cover 26 is cuffed approximately five inches to expose the interior of the leg portion 60. The cuffed portion 76 defines a cuffed opening 78. As shown in the drawings, the leg portion 60 has been cuffed such that the elastic band 62 now generally aligns with the elastic band 64. It is to be understood that depending on the length of the leg portion 60, the elastic bands 62, 64 may not necessarily align with each other. Next, as shown in FIGS. 15 and 16, the cuffed portion 76 of the shoe cover 26 is grasped and folded such that the cuffed opening 78 is generally even with the heel 74 of the shoe cover 26. Thereafter, as shown in FIGS. 17 and 18, the toe 72 is grasped and folded under so that the toe 72 is generally aligned with the center of the sole 70.

Figure 19:
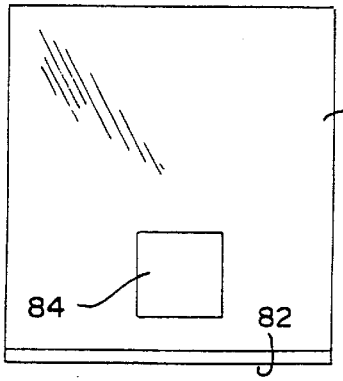

Thereafter, the steps discussed above and shown in FIGS. 12–18 are repeated with another shoe cover to form a like folded shoe cover 26*a* as shown in FIG. 19.

The folded shoe covers 26, 26*a* are stacked on top of each other with the cuffed opening 78 on each shoe cover 26, 26*a* facing away from the folder.

As shown in FIG. 19, a bag 80 is placed on the folding table with the opening 82 of the bag 80 facing the folder and a label 84 which has been pre-supplied on the bag 80 facing upwardly to the folder. The stacked pair of shoe covers 26, 26*a* are placed in the bag 80 with the cuffed openings 78 first passing through the opening 82 in the bag 80.

Figure 20:
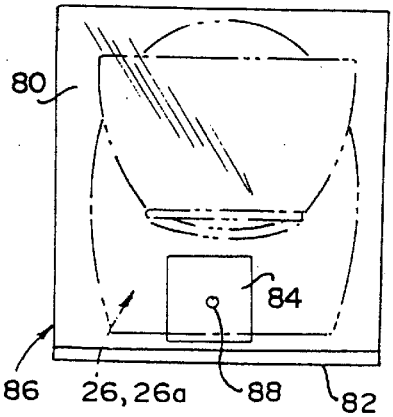
Figure 20:
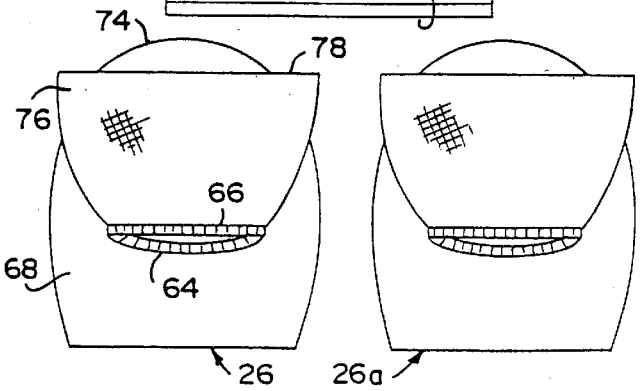

If the folder is packaging disposable, sterile nonlaundered shoe covers 26, 26*a*, the bag 80 is vacuum sealed to form a pair package 86 of shoe covers. If the folder is packaging reusable, laundered cleanroom shoe covers 26, 26*a*, the air is pushed out of the bag 80 and the bag 80 is heat sealed to form a pair package 86 of shoe covers 26, 26*a*. A pressure sensitive label 88 is placed on the label 84 to denote what type of shoe covers 26, 26*a* the bag 80 contains as shown in FIG. 20.

To don one of the shoe covers 26, the wearer opens the non-sealed end of the bag 80 which has the cuffed portion 76 proximate thereto. The cuffed portion 76 of the shoe cover 26 is grasped by the wearer, such that only the interior surface of the shoe cover 26 is grasped during removal from the bag 80 and during subsequent handling by the wearer during donning. As shown in FIG. 11, the wearer, still holding only the cuffed portion 76 of the shoe cover 26, inserts his or her foot through the cuffed opening 78 until the foot is completely within and enclosed by the foot portion of the shoe cover 26. As the wearer's foot is inserted, the shoe cover 26 unfolds without the wearer touching the exterior of the shoe cover 26. The elastic band 64 securely grips the wearer's ankle. Thereafter, the cuffed portion 76 is uncuffed, with the wearer only grasping the interior surface of the shoe cover 26 as shown in FIG. 11. The upper elastic band 66 securely grasps the wearer's calf as shown in FIG. 10 and the shoe cover 26 is completely donned. Thus, the shoe cover 26 is easily donned without the wearer touching the exterior surface of the shoe cover 26. Thereafter, the same procedure is used to don the other shoe cover 26*a*.

Attention is now directed to the specifics of packaging and donning the hood 28. The hood 28 is shown in its donned position in FIG. 21 and its method of donning by a wearer is partially shown in FIG. 22. As shown, the hood 28 is an open face hood, however, it is to be understood that a hood solely having a cutout for the wearer's eyes may also be cuffed, folded and packaged in a like manner. The hood 28 is formed from a generally truncated conical portion 92 which is formed by a pair of front panels and a back panel, and a top portion 94 which is formed by a top panel. The front panels are joined together along one of the edges along front of the hood 28, and the other edges of the front panels are joined with the back panel along the sides of the hood 28, and the front panels and the back panel are joined with the top panel or portion 92 at the top of the hood 28. Each of the panels are joined together by suitable means along respective seams (not shown), such as by sewing. A face opening 96 is provided between the top portion 94 and the truncated conical portion 92 proximate to the top of the hood 28, and a neck opening 98 is provided at the bottom of the truncated conical portion 92. First and second ties 100, 102 and first and second loops 104, 106 are provided on the truncated conical portion 92. The ties 100, 102 are attached to the truncated conical portion 92 along a top portion thereof and the loops 104, 106 are attached to the truncated conical portion 92 at a distance which is spaced from the tie connections to the truncated conical portion 92. The ties 100, 102 and the loops 104, 106 are joined with the truncated conical portion 92 by suitable means, such as by sewing.

The novel method of cuffing, folding and packaging the hood 28 is shown in FIGS. 23–33.

First, as generally shown in FIG. 23, a folder (not shown) places the hood 28 on a folding table (not shown) with the face opening 96 centered and facing up and away from the folder. All of the wrinkles in the hood 28 are smoothed out, so that the hood 28 is flat.

Tie 100 is pushed through loop 104 and drawn therethrough until the tie 100 is taught. The tie 100 is then folded across the front of the truncated conical portion 92 to the lower right corner of the truncated conical portion 92 as shown in the drawings. Thereafter, as shown in FIG. 24, tie 102 is pushed through loop 106; drawn therethrough until taught; and then folded across the truncated conical portion 92 to the lower left corner of the truncated conical portion 92 as shown in the drawings.

Next, the edge of the neck opening 98 is grasped and the bottom end of the truncated conical portion 92 is cuffed or turned inside-out around the entire circumference of the hood 29 to form a cuffed portion 108 as shown in FIGS. 25 and 26. That is, the bottom edge of the hood 28 forming the neck opening 98 is moved from the end as shown in FIG. 24, to a position which is intermediate of the hood 28 as shown in FIG. 25, thereby exposing a portion of the interior surface of the hood 28 while leaving a portion of the exterior of the hood 28 exposed. The hood 28 is cuffed to expose approximately five inches of the interior of the truncated conical portion 92. The cuffed portion 108 defines a cuffed opening 110.

Thereafter, as shown in FIGS. 27 and 28, the left side of the cuffed portion 108 and a portion of the hood 28 thereabove are folded approximately two-thirds (⅔) of the way across the front of the hood 28 keeping the cuffed portion 108 aligned to form a first folded over portion 112; and thereafter, the right side of the cuffed portion 108 and a portion of the hood 28 thereabove are folded approximately two-thirds (⅔) of the way across the front of the hood 28 keeping the cuffed portion 108 aligned to form a second folded over portion 114, such that the second folded over portion 114 partially overlaps the first folded over portion 112. Next, as shown in FIG. 29, the cuffed and folded left side of the hood 28 is folded to the center of the hood 28 keeping the cuffed opening aligned to form a third folded over portion 116; and the cuffed and folded right side of the hood 28 is folded to the center of the hood 28 keeping the cuffed opening aligned to form a fourth folded over portion 118. The inner edges of the third and fourth folded over portions 116, 118 meet along a centerline of the hood 28. Thereafter, as shown in FIGS. 30 and 31, the top edge of the hood 28 is grasped just above the face opening 96 and is folded down to align with the cuffed opening 110.

The cuffed and folded hood 28 is turned so that the face opening 96 is facing downwardly on the folding table and the cuffed opening 110 is facing away from the folder. As shown in FIG. 32, a bag 120 is placed on the folding table with the opening 122 of the bag 120 facing the folder and a label 124 which has been pre-supplied on the bag 120 facing upwardly to the folder. The hood 28 is placed in the bag 120 with the cuffed opening 110 first entering the opening 122 in the bag 120.

If the folder is packaging a disposable, sterile non-laundered hood 28, the bag 120 is vacuum sealed. If the folder is packaging a reusable, laundered cleanroom hood 28, the air is pushed out of the bag 120 and the bag 120 is heat sealed. A pressure sensitive label 128 is placed on the label 124 to denote what type of hood 28 the bag 120 contains as shown in FIG. 33.

Figure 22:
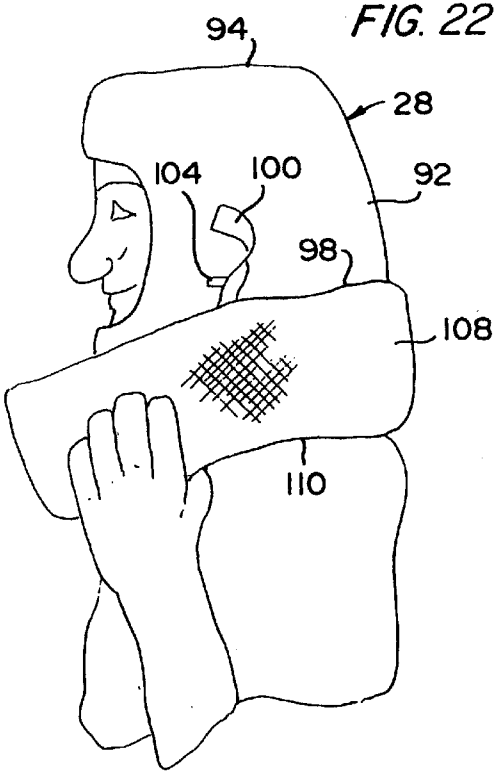
FIG. 22 is a perspective view of the hood shown in FIG. 21 being donned by the wearer.
Figure 34:
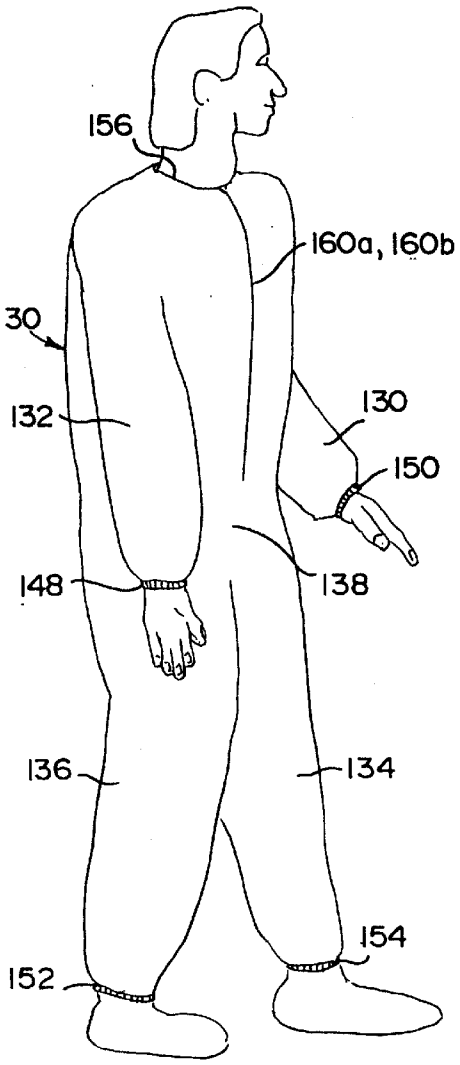
FIG. 34 is a perspective view of a coverall which has been donned by a wearer.

To don the hood 28, the wearer opens the non-sealed end of the bag 120 which has the cuffed opening 110 proximate thereto. The cuffed portion 108 of the hood 28 is grasped by the wearer such that only the interior surface of the hood 28 is grasped during removal from the bag 120 and during subsequent handling during donning. As shown in FIG. 22, the wearer, still holding only the cuffed portion 108 of the hood 28, inserts his or her head through the cuffed opening 110 until the wearer's head is completely within the hood 28. As the wearer's head is inserted, the hood 28 unfolds without the wearer touching the exterior surface of the hood 28. The wearer aligns the face opening 96 with his or her face. Thereafter, the cuffed portion 108 is uncuffed, with the wearer only grasping the interior surface of the hood 28 as shown in FIG. 22. When donned, the top portion 94 sits on top of the wearer's head and the truncated conical portion 92 extends downwardly around the wearer's head, thereby covering the head and the neck. Thus, the hood 28 is easily donned without the wearer touching the exterior surface of the hood 28.

Attention is now directed to the specifics of packaging and donning the coverall 30. The coverall 30 is shown in its donned position in FIG. 34 and its method of donning by a wearer is partially shown in FIGS. 35 and 36. The coverall 30 is formed from a plurality of panels joined together along seams (not shown) by suitable means. The coverall includes left and right tubular arm portions 130, 132, left and right tubular leg portions 134, 136 and a body portion 138 which connects the arm and leg portions 130, 132, 134, 136 together. Each of the arm portions 130, 132 and the leg portions 134, 136 define appendage openings 140, 142, 143, 144, respectively, at the ends thereof which have elastic bands 146, 148, 150, 152, respectively, secured therein by placing the elastic band 146, 148, 150, 152 at the end of the respective arm or leg portions 130, 132, 134, 136 and folding the end of the arm or leg portion 130, 132, 134, 136 over the respective elastic bands 146, 148, 150, 152 and securing this folded over configuration by suitable means, such as by sewing. A thumb loop (not shown), like that shown in the sleeve 24 in FIGS. 1–9 may provided at the opening 140, 142 defined by each of the arm portions 130, 132 for reasons described herein. The body portion 138 has a neck opening 156 therein and a slit 158 along the front of the coverall 30. A zipper, having left and right edges 160*a*, 160*b*, respectively, is provided along the edges of the slit 158 and a blow-through flap 162 is attached to one of the edges thereof and is provided behind the zipper edge 160*a*.

The novel method of cuffing, folding and packaging the coverall 30 is shown in FIGS. 37–46.

First, a folder places the unzipped coverall 30 on a folding table (not shown) with the front of the coverall 30 facing down. That is, the edges 160*a*, 160*b* of the zipper are facing downwardly on the folding table.

Figure 37:
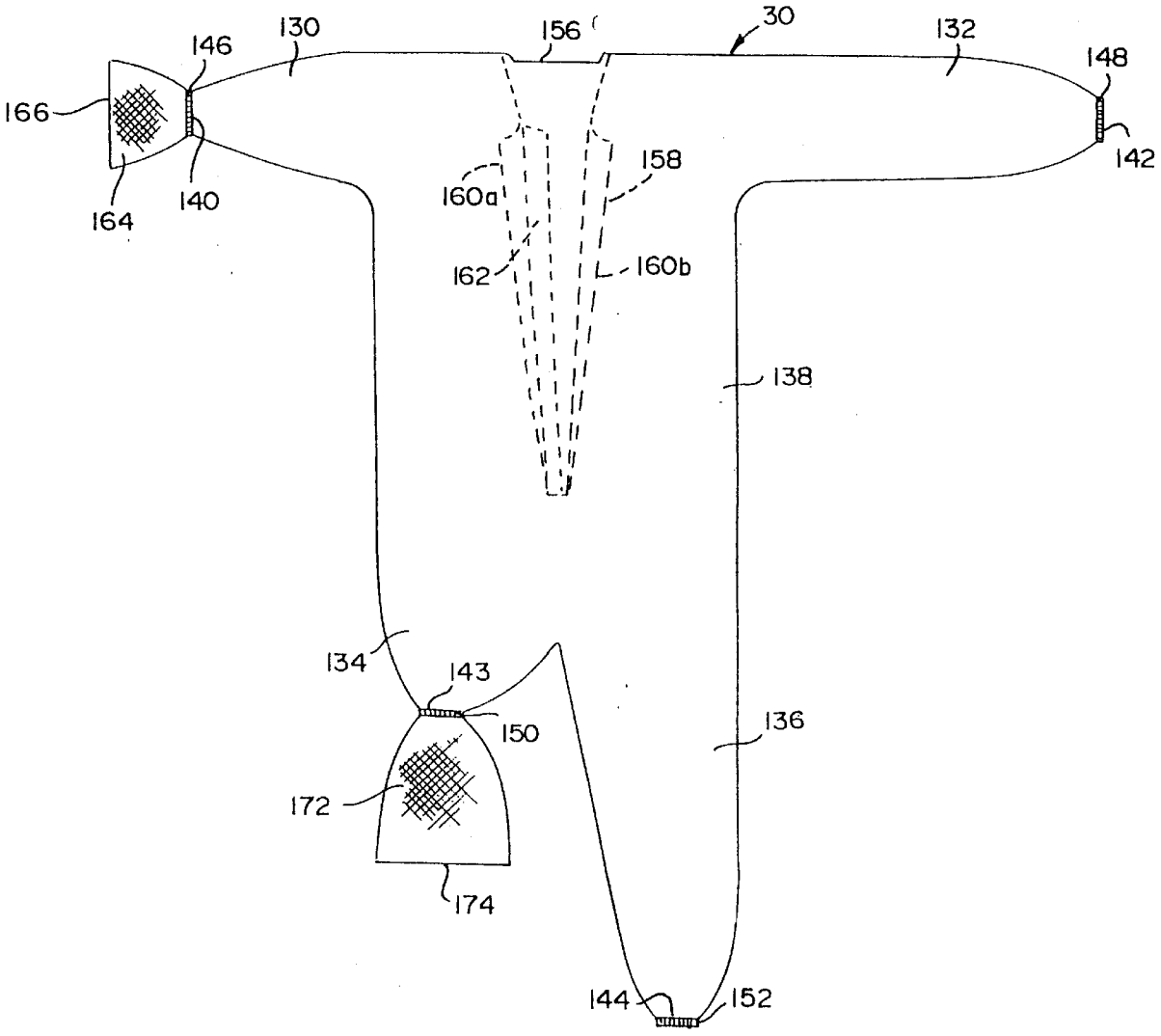
FIGS. 37–46 show the steps in cuffing, folding and packaging the coverall in accordance with the features of the invention.
Figure 40:
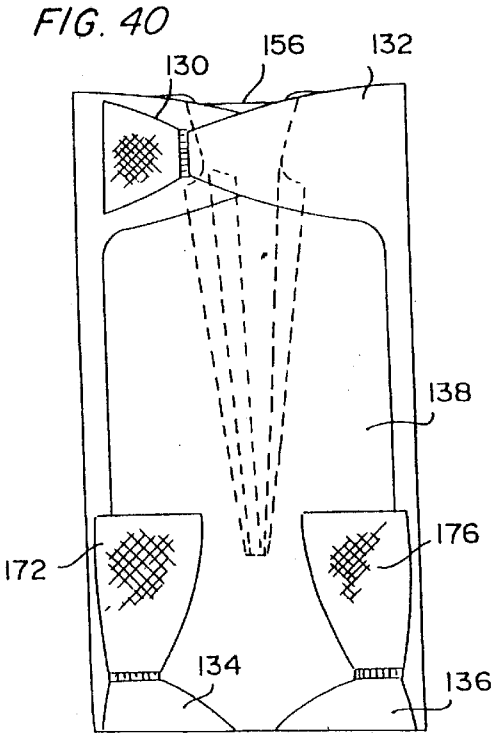

Next, as shown in FIG. 37, the end of the left arm portion 130 proximate to the opening 140 is grasped and the end of the arm portion 130 is cuffed or turned inside-out around the entire circumference of the arm portion 130 to form a cuffed arm portion 164, thereby exposing a portion of the interior surface of the arm portion 130 while leaving a portion of the exterior surface of the arm portion 130 exposed. The arm portion 130 is folded cuffed to expose approximately six inches of the interior surface of the arm portion 130. The cuffed arm portion 164 defines a cuffed opening 166. The same steps are repeated for the right arm portion 132 as shown in FIG. 38 to form a cuffed arm portion 168 which defines a cuffed opening 170.

Next, as also shown in FIG. 37, the end of the left leg portion 134 proximate to the opening 143 is grasped and the end of the leg portion 134 is cuffed or turned inside-out around the entire circumference of the leg portion 134 to form a cuffed leg portion 172, thereby exposing a portion of the interior surface of the leg portion 134 while leaving a portion of the exterior surface of the leg portion 134 exposed. The leg portion 134 is folded inside out to expose approximately twelve inches of the interior surface of the leg portion 134. The cuffed leg portion 172 defines a cuffed opening 174. The same steps are repeated for the right leg portion 136 as shown in FIG. 38 to form a cuffed leg portion 176 which defines a cuffed opening 178.

Figure 39:
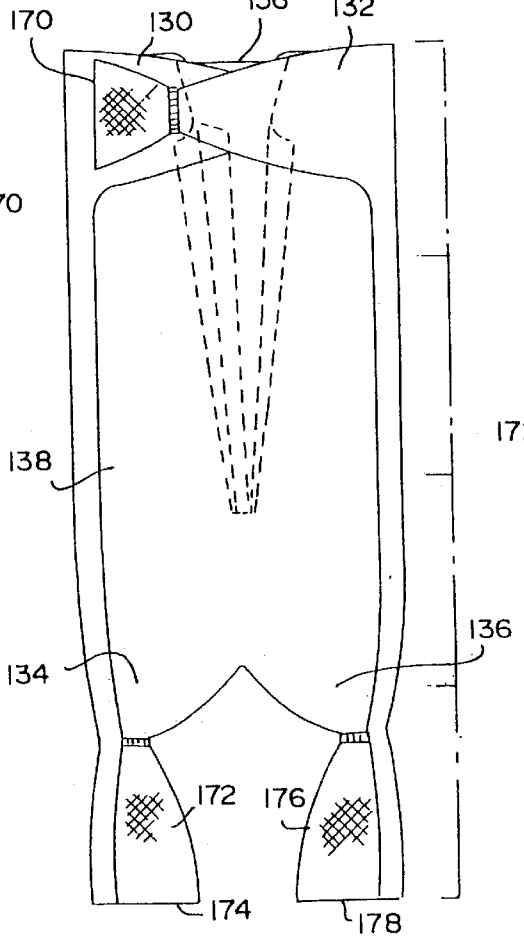
Figure 38:
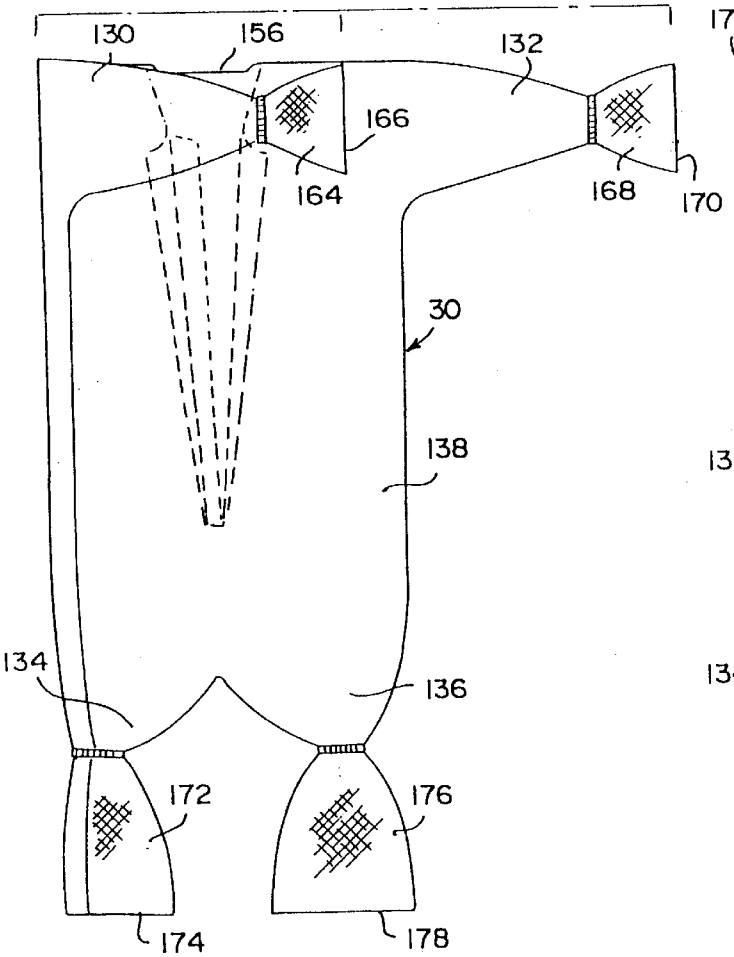

Next, as shown in FIG. 38, the cuffed left arm portion 130 and a portion of the left side of the coverall 30 are folded across the back of the coverall 30 one third (⅓) of the width of the coverall 30. As shown in FIG. 39, the cuffed right arm portion 132 and a portion of the right side of the coverall 30 are then folded across the back of the coverall 30 one third (⅓) of the width of the coverall 30. Thus, the cuffed arm portions 130, 132 overlap each other.

Figure 41:
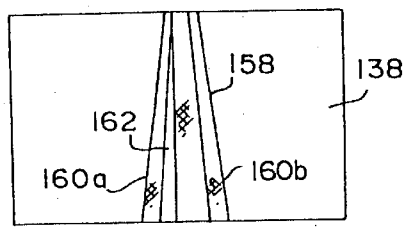

Thereafter, both of the cuffed leg portions 134, 136 are grasped by the folded cuff portions 172, 176 and are folded one-fourth (¼) of the way up the back of the coverall 30. The leg portions 134, 136 and body 138 are repeatedly folded in one-fourth (¼) increments until the leg portions 134, 136 are even with the neck line 156 of the coverall 30 as shown in FIG. 41. Because of this folding, a middle portion of the slit 158 faces upwardly toward the folder.

Figure 42:
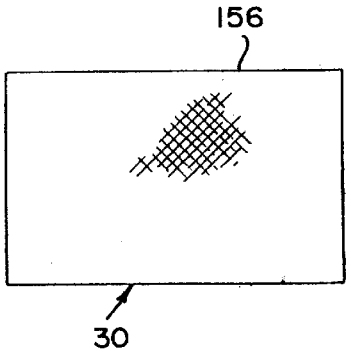
Figure 42:
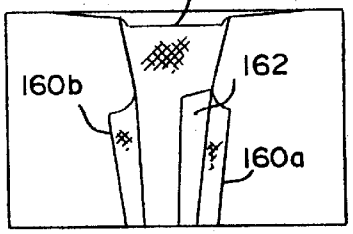
Figure 43:
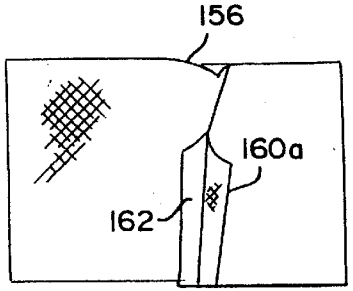
Figure 44:
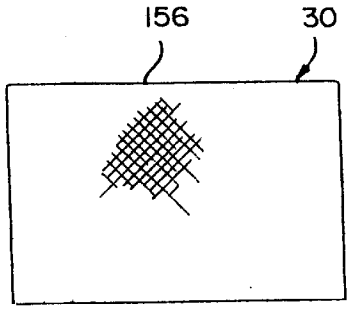

Next, as shown in FIG. 42, the coverall 30 is turned over on the folding table so that the neck line 156 and the top of the slit 158 is facing up to and away from the folder. The left side of the coverall 30 is grasped by the left edge 160*a* of the unzipped zipper and the chest of the coverall 30 is rolled open starting with the zipper edge 160*a* and exposing the inside of the chest portion of the coverall 30 until the chest of the coverall 30 is rolled open all the way around to the back of the coverall shoulder where the neckline 156 and the folded leg portions and body portion 134, 136, 138 meet as shown in FIG. 43. Thereafter, the right side of the coverall 30 is grasped by the right edge 160*b* of the unzipped zipper and the chest of the coverall 30 is rolled open starting with the zipper edge 160*a* and exposing the inside of the chest portion of the coverall 30 until the chest of the coverall 30 is rolled open all the way around to the back of the coverall shoulder where the neckline 156 and folded leg portions and body portion 134, 136, 138 meet as shown in FIG. 44. As shown in FIG. 44, after the chest has been rolled open, only the interior surface is exposed on top of the coverall 30.

Figure 45:
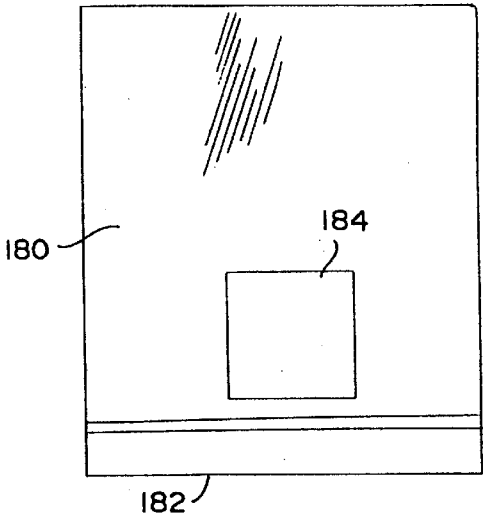

As shown in FIG. 45, a bag 180 is placed on the folding table with the opening 182 of the bag 180 facing the folder and a label 184 which has been pre-supplied on the bag 180 facing upwardly to the folder. The cuffed and folded coverall 30 is placed in the bag 180 with the neck opening 156 first entering the opening 182 in the bag 180.

Figure 46:
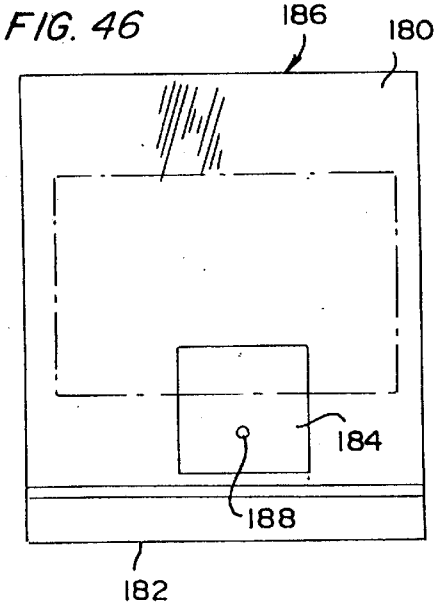

If the folder is packaging a disposable, sterile non-laundered coverall 30, the bag 180 is vacuum sealed to form a package 186. If the folder is packaging a reusable, laundered cleanroom coverall 30, the air is pushed out of the bag 180 and the bag 180 is heat sealed to form a package 186. A pressure sensitive label 188 is placed on the label 184 on the bag 180 to denote what type of coverall 30 the bag contains as shown in FIG. 46.

Figure 35:
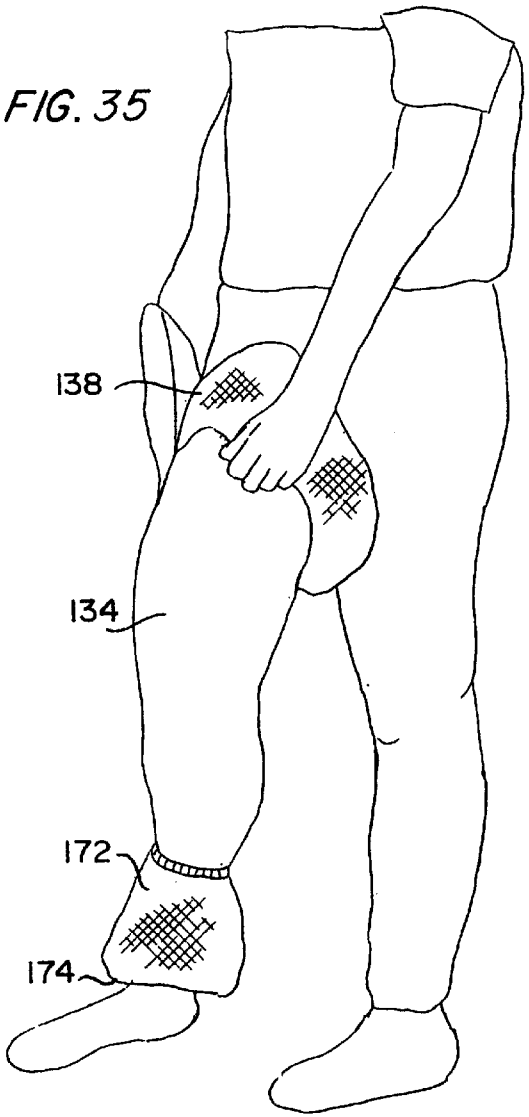
FIGS. 35 and 36 are perspective views of the hood shown in FIG. 34 being donned by the wearer.
Figure 21:
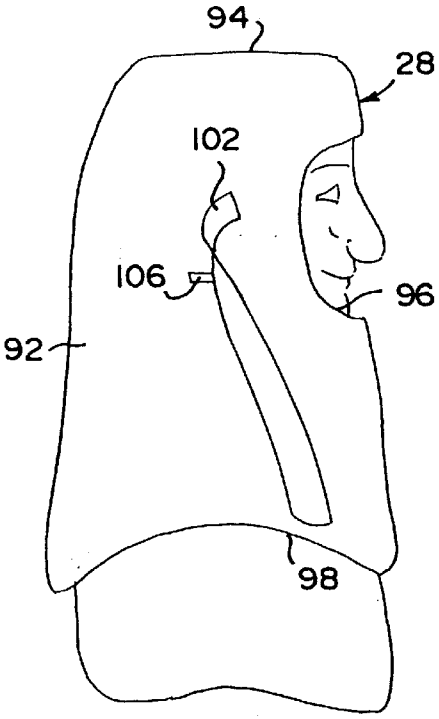
FIG. 21 is a perspective view of a hood which has been donned by a wearer.
Figure 36:
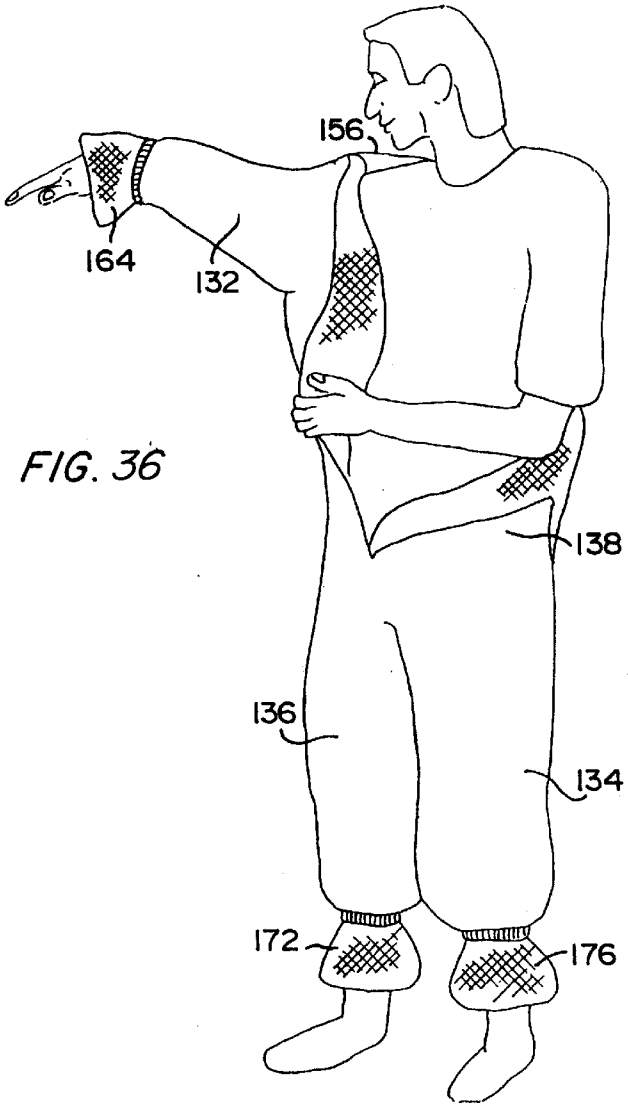

To don the coverall 30, the wearer opens the non-sealed end of the bag 180 which has the neck opening 156 proximate thereto. The coverall 30 is grasped by the wearer such that only the interior surface of the coverall 30 is grasped during removal from the bag and during subsequent handling during donning. As shown in FIG. 35, the wearer, still holding only the interior surface of the coverall 30, inserts his or her legs through the unzipped body portion 138 of the coverall 30 and into each of the respective leg portions 134, 136, being careful not to allow the coverall 30 to touch the floor, until each of the wearer's feet extend out the cuffed openings 174, 178. Because the leg portions 134, 136 are cuffed, the coverall 30 is less likely to drag along or contact the floor as it is not its full length. As the wearer's legs are inserted, the coverall 30 starts to unfold without the wearer touching the exterior surface of the coverall 30. Thereafter, the body portion 138 of the coverall 30 is lifted upwardly with the wearer still only touching the interior surfaces of the coverall 30. The wearer next inserts his or her arms through the unzipped body portion 138 of the coverall 30, with the wearer only grasping the interior surfaces of the coverall 30 as shown in FIG. 36, and into each of the respective arm portions 130, 132 until the wearer's hands extend out the cuffed openings 166, 170. As the wearer's arms are inserted, the coverall 30 unfolds without the wearer touching the exterior surface of the coverall 30.

Thereafter, the cuffed arm portions 164, 168 and the cuffed leg portions 172, 176 are uncuffed, with the wearer only grasping the interior surface of the coverall 30. If thumb loops are provided on the arm portions 130, 132, the wearer places his or her thumb through the thumb loop. The wearer zips the zipper 160*a*, 160*b* and the coverall 30 is fully donned as shown in FIG. 37. The blow-through flap 162 is behind the zipper 160*a*, 160*b* when the coverall 30 is fully donned. Thus, the coverall 30 is easily donned without the wearer touching the exterior surface of the coverall 30.

The following description is applicable to each of the garments after they have been placed in the bag 48, 80, 120, 180 to form the packages 54, 86, 126, 186 shown in the drawings. These steps are not shown in the drawings.

One hundred and fifty (150) packages 54 of sleeves 24; or one hundred (100) packages 86 of shoe covers 26; or one hundred (100) packages 126 of hoods 28; or twenty-five (25) packages 186 of the coveralls 30 are placed into a clean room bag (not shown) if the garments are laundered or placed into a non-cleanroom bag (not shown) if the garments are non-laundered. All the packages 54, 86, 126, 186 are placed in the clean room bag or non-cleanroom bag facing the same direction with the label side facing upwardly. If a disposable, sterile non-laundered garment is being packaged, the cleanroom bag is vacuum heat-sealed. If a reusable, laundered cleanroom garment is being packaged, the extra air is pushed out of the non-cleanroom bag and the non-cleanroom bag is heat-sealed.

Thereafter, the appropriate label is placed on the side of the cleanroom or non-cleanroom bag. The cleanroom or non-cleanroom bag is placed in a carton liner, the excess air is pressed out and the carton liner, and it is closed with a twist tie. If the garments are laundered, a certificate of cleanliness is placed in a bag and the bag is twist tied to the top of the carton liner. If the garments are not laundered, this step is skipped. If the garments are sterilized, then a certificate of sterility is placed with sterility assurance dot in a bag and the bag is twist tied to the carton liner.

The finished product is placed in a carton, and the carton is sealed by suitable means, such as by taping. The appropriate carton label is placed on the end of the carton, preferably centered in the middle of the carton end.

If the garments are laundered, a copy of the certificate of cleanliness is placed in a pressure sensitive window label with the certificate of sterility title showing through the window. The window having the certificate of sterility showing therethrough is applied to the center of the side of the carton. If the garments are sterilized, then a copy of the certificate of sterility with a sterility assurance dot is placed in a pressure sensitive window label with the certificate of sterility title and sterility dot showing through the window. The window is applied to the right of the certificate of cleanliness or in the center of the side of the carton if the product is not laundered.

Figure 47:
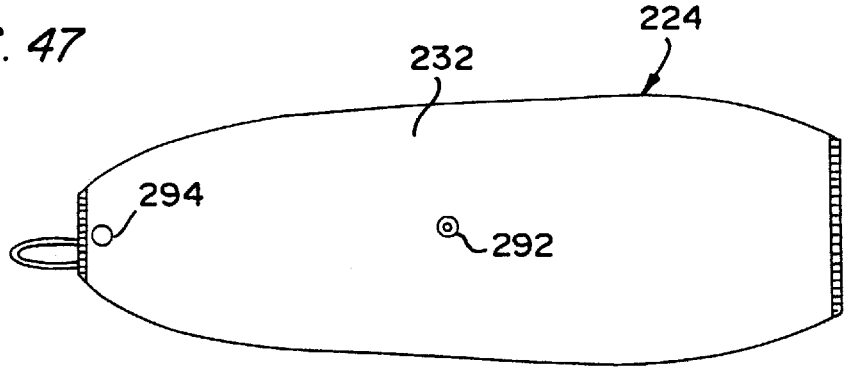
FIG. 47 provides an alternative means of securing the ends of the sleeves, arm portions and/or leg portions of the coverall in a cuffed condition.

As an alternative to using the elastic bands at the ends of the sleeves, arm portions and/or leg portions, a snap can be provided. For example, as shown in FIG. 47, one portion 292 of the snap is provided approximately in the middle of the tubular body portion 232 of the sleeve 224 and the other portion 294 of the snap is provided proximate to the end of the sleeve 224. When the sleeve 224 is cuffed to form the cuffed portion 44, the snap portions 292, 294 are joined to securely hold the cuffed portion 44. The snap portions 292, 294 are easily separated to extend the sleeve 28 to its full length without touching the exterior surface of the sleeve 228. Therefore, it is clear that snaps instead of the elastic bands could be provided on any of the garments disclosed herein.

Because during donning of the garments, the user does not touch the exterior surface thereof, particle, extractable and bio-contamination from the hands of a wearer are prevented. Moreover, the garments are packaged so that the garments are donned without positioning the garments before donning. This again, prevents contamination and saves time.

While terms such as right, left, top, bottom have been described with respect to the orientation of the garments during folding, it is to be understood that these terms have been used solely for the purpose of describing the novel method.

While preferred embodiments of the present invention are shown and described, it is envisioned that those skilled in the art may devise various modifications of the present invention without departing from the spirit and scope of the appended claims.

The invention claimed is:

1. A method of forming a sterile garment package to facilitate donning of a garment by a wearer, said method comprising the steps of:

(a) providing a garment having an interior surface, an exterior surface and at least one opening for the insertion of an appendage of a wearer therethrough, such as an arm, a leg or a head;

(b) laying said garment on a surface in a flattened condition with said exterior surface exposed;

(c) cuffing a portion of said garment around said opening to expose a portion of said interior surface of said garment while leaving a portion of said exterior surface of said garment exposed; and (d) folding said cuffed portion of said garment onto said exposed portion of said exterior surface at least once.

2. A method as defined in claim 1, further including the step of: (e) placing said folded garment into a bag and sealing said bag.

3. A method as defined in claim 1, wherein said garment provided in step (a) is a sleeve formed from a generally tubular portion having a first and second openings at opposite ends thereof for the insertion of an arm of a wearer therethrough;

wherein in step (b) a portion of said sleeve is cuffed around said first opening to expose a portion of said interior surface of said sleeve while leaving a portion of said exterior surface of said sleeve exposed.

4. A method as defined in claim 3, wherein said sleeve is cuffed around said first opening so as to expose approximately four inches of the interior surface of the sleeve.

5. A method as defined in claim 3, wherein said sleeve is provided with elastic bands around said openings.

6. A method as defined in claim 3, wherein said sleeve is provided with snaps thereon such that when said sleeve is cuffed, said cuffed portion is snapped to the remainder of the sleeve to hold said cuffed portion in place.

7. A method as defined in claim 3, wherein in step (d), said sleeve is folded in half such that the opening formed by cuffing said sleeve around said first opening and said second opening are aligned with each other.

8. A method of donning a sleeve by a wearer which has been cuffed and folded in accordance with the method specified in claim 3, comprising the steps of:

grasping said folded and cuffed sleeve solely by the exposed interior surface thereof;

inserting an arm of the wearer into said opening defined by said cuffed portion;

extending said wearer's arm through the sleeve until the wearer's hand extends through the second opening, thereby causing said sleeve to unfold;

uncuffing said cuffed portion of said sleeve by solely grasping the exposed interior surface of said sleeve.

9. A method as defined in claim 1, wherein said garment provided in step (a) is a shoe cover formed from a generally tubular leg portion having a first and second ends defining respective first and second openings at opposite ends of said leg portion, and a foot portion defining a heel, a toe and a sole and being attached to said second end of said tubular portion, said leg portion adapted for covering a portion of the wearer's leg and said first opening being adapted for having a foot and a portion of a leg of the wearer inserted therethrough, and said foot portion adapted for covering and enclosing the wearer's foot;

and wherein in step (b) a portion of said tubular portion around said first opening is cuffed to expose a portion of said interior surface of said shoe cover while leaving a portion of said exterior surface of said shoe cover exposed.

10. A method as defined in claim 9, wherein said shoe cover is cuffed around said first opening so as to expose approximately five inches of the interior surface of said tubular portion of said shoe cover.

11. A method as defined in claim 9, wherein said tubular portion is provided with elastic bands around said openings.

12. A method as defined in claim 9, wherein in step (d), said shoe cover is folded such that the end of said tubular portion defined by said cuffed portion and said heel of said foot portion are generally aligned with each other.

13. A method as defined in claim 12, wherein in step (d), said toe of said foot portion is folded to generally align said toe with a middle of said sole.

14. A method of donning a shoe cover by a wearer which has been cuffed and folded in accordance with the method specified in claim 10, comprising the steps of:

grasping said folded and cuffed shoe cover solely by the exposed interior surface thereof;

inserting a foot and leg of the wearer into said opening defined by said cuffed portion;

extending said wearer's foot into said foot portion until the wearer's foot is enclosed by said foot portion and extending said wearer's leg into said leg portion until a portion of said wearer's leg is enclosed within said tubular leg portion, thereby causing said shoe cover to unfold;

uncuffing said cuffed portion of said tubular portion by solely grasping the exposed interior surface of said tubular portion.

15. A method as defined in claim 1, wherein said garment provided in step (a) is a hood formed from a generally truncated conical portion defining an opening at a bottom thereof and a top portion attached thereto, said hood being adapted for covering a wearer's head and neck and said opening being adapted for having a wearer's head and neck being inserted therethrough;

and wherein in step (b) a portion of said truncated conical portion around said opening is cuffed to expose a portion of said interior surface of said hood while leaving a portion of said exterior surface of said hood exposed.

16. A method as defined in claim 15, wherein said hood is further provided with a pair of ties and a pair of loops proximate to said ties and further including the step of threading each tie through a respective loop before said hood is folded.

17. A method as defined in claim 15, wherein said hood is cuffed around said opening so as to expose approximately five inches of the interior surface of said hood.

18. A method as defined in claim 15, wherein in step (d), said hood is folded such that a first portion of said cuffed portion and a first portion of said hood which has not been cuffed are folded over across the remainder of the hood to form a first folded portion and thereafter, said hood is again folded such that a second portion of said cuffed portion and a second portion of said hood which has not been cuffed are folded over onto the remainder of the hood to form a second folded portion.

19. A method as defined in claim 18, wherein said first portion of said cuffed portion and said first portion of said hood which has not been cuffed are folded over approximately two-thirds of the way across the remainder of the hood and said second portion of said cuffed portion and said second portion of said hood which has not been cuffed are folded over approximately two-thirds of the way across the remainder of the hood.

20. A method as defined in claim 18, wherein in step (d), said first and second folded portions are folded to a center of the hood.

21. A method as defined in claim 20, wherein in step (d), said hood is folded in half so said top aligns with the opening formed by said cuffed portion.

22. A method of donning a shoe cover by a wearer which has been cuffed and folded in accordance with the method specified in claim 15, comprising the steps of:

grasping said folded and cuffed hood solely by the exposed interior surface thereof;

inserting a head and neck of the wearer into said opening defined by said cuffed portion;

extending said wearer's head into said hood until the wearer's head is enclosed by said hood, thereby causing said hood to unfold;

uncuffing said cuffed portion of said hood by solely grasping the exposed interior surface of said hood.

23. A method as defined in claim 1, wherein said garment provided in step (a) is a coverall formed from a pair of generally tubular leg portions having a first and second ends defining respective first and second openings at opposite ends of said leg portions, a pair of generally tubular arm portions having a first and second ends defining respective first and second openings at opposite ends of said arm portions, and a body portion connecting said leg portions and said arm portion together, said coverall defining a front and a back;

and wherein in step (b) a portion of each said leg portion and each said arm portion around each said first opening is cuffed to expose a portion of said interior surface of said coverall while leaving a portion of said exterior surface of said coverall exposed.

24. A method as defined in claim 23, wherein each said leg portion is cuffed around each said first opening so as to expose approximately twelve inches of the interior surface of said leg portion and each said arm portion is cuffed around each said first opening so as to expose approximately six inches of the interior surface of said arm portion.

25. A method as defined in claim 23, wherein each said leg portion and each said arm portion is provided with an elastic band around said first opening.

26. A method as defined in claim 23, wherein at least one of said leg portions or said arm portions of said coverall include snaps thereon such that when said leg portions or arm portions are cuffed, said resulting cuffed portion is snapped to the remainder of the leg portion or arm portion to hold said resulting cuffed portion in place.

27. A method as defined in claim 23, wherein in step (d), said coverall is folded such that each cuffed arm portion and a respective portion of said coverall is folded across said back of said coverall and each said cuffed leg portion is folded up said back of said coverall.

28. A method as defined in claim 27, wherein each cuffed arm portion and a respective portion of said coverall is folded approximately two-thirds of the way across said back of said coverall and each said cuffed leg portion is folded approximately one-fourth of the way up said back of said coverall.

29. A method as defined in claim 27, wherein said leg portions are folded up said back of said coverall until said leg portions are approximately even with a neck line of said coverall.

30. A method as defined in claim 29, wherein said coverall further includes a center opening in the front of said body portion which can be selectively closed and further including the step of rolling each side of said coverall starting at said center opening to said back of said coverall where said neck line and said folded leg portions meet to expose the interior of said body portion.

31. A method of donning a coverall by a wearer which has been cuffed and folded in accordance with the method specified in claim 23, comprising the steps of:

grasping said folded and cuffed coverall solely by the exposed interior surface thereof;

inserting a leg of the wearer into said opening defined by said cuffed portion;

extending said wearer's legs into said leg portions, thereby causing said coverall to partially unfold;

bringing said body portion of said coverall up over the torso of the wearer, thereby causing said coverall to further partially unfold;

extending said wearer's arms into said arm portions, thereby causing said coverall to completely unfold;

uncuffing said cuffed portions of said leg and arm portions by solely grasping the exposed interior surfaces of said leg and arm portions.

* * * * *